US005110058A

United States Patent [19]

Rawson

[11] Patent Number: 5,110,058

[45] Date of Patent: May 5, 1992

[54] ROCK CRUSHER

[76] Inventor: James W. Rawson, 169 Munyan Rd., Putnam, Conn. 06260

[21] Appl. No.: 694,812

[22] Filed: May 2, 1991

[51] Int. Cl.[5] ..... B02C 17/14

[52] U.S. Cl. ..... 241/264

[58] Field of Search ..... 241/30, 264, 267, 268

[56] References Cited

U.S. PATENT DOCUMENTS

| | | | |
|---|---|---|---|
| 160,682 | 3/1875 | Johnson . | |
| 2,605,051 | 7/1952 | Bogie | 241/264 |
| 3,170,644 | 2/1965 | Gaulde . | |
| 3,386,667 | 6/1968 | May . | |
| 3,976,255 | 8/1976 | Edwards . | |

OTHER PUBLICATIONS

Brochure, Pioneer Overhead Eccentric Jaw Crushers, Portec Pioneer Division, JC866, 12 pages (undated).

Brochure, Aggregate and Sand Plant Equipment-Rock, Kobe Steel, Ltd., No. M110050, front cover, pp. 1-10, and rear cover only (undated).

Brochure, Kue-Ken® Jaw Crushers, KUE-Ken® Division of Process Technology Corporation, Bulletin 802, pp. 1-12 (undated).

*Primary Examiner*—Douglas D. Watts

*Attorney, Agent, or Firm*—Albert W. Hilburger

[57] ABSTRACT

Apparatus is provided for crushing rock into aggregate which utilizes a movable jaw operating relative to a fixed jaw. The movable jaw is supported on upper and lower toggle plates which are positioned in non parallel planes. Rock to be crushed is received in an upper entry region defined by the jaws and by opposed cheek plates cooperable with the jaws. Upon reciprocating movement of an hydraulic actuator, a major movement imparted to the movable jaw at its upper region is in a generally upright plane and a major movement imparted to the movable jaw at its lower region is in a generally horizontal plane transverse of the upright plane. In this manner, improved initial cracking of the rock as it enters the upper entry region is achieved and increased production flow of crushed aggregate is achieved at a discharge region by reason, at that location, of the relative horizontal movement between the fixed and movable jaws.

18 Claims, 4 Drawing Sheets

20
22
24
26
28
30
34
38
40
42
44
46
48
50
54
56
58
60
62
64
66
68
70
72
74
78
80
82
84
86
88
92
94

ROCK CRUSHER

BACKGROUND OF THE INVENTION

I. Field of the Invention

The present invention relates generally to apparatus for crushing rock into aggregate and, more particularly, to such apparatus utilizing a uniquely supported movable jaw which assures maximum production of aggregate.

II. Description of the Prior Art

In conventional practice, jaw crushers of the type utilizing a single or a pair of pivoted jaws have long been known. In typical fashion, the jaws are usually mounted at their upper regions on an eccentric with a toggle being provided at the lower region of the jaw. Through the action of the eccentric, the jaw is moved to and from its innermost crushing position. These jaw crushers are very powerful but because of the mass of the structure, and particularly the eccentric drive mechanism, the frequency at which they are capable of operating is relatively low resulting in limited productivity. In jaw crushers of this construction, the moving jaw forces the rock to be crushed both up and down causing severe rubbing action which quickly wears out the jaw plates and wastes power. Maximum motion is at the top, resulting in minimum leverage being applied on the largest rock where maximum leverage is actually needed. As would be expected, bearing pressures are substantial.

A variation of the overhead eccentric type of crusher just described is the Blake type crusher. In this instances, a jaw swings on a fixed axle while a pitman whose upper end follows an eccentric is employed to operate a toggle which, in turn, swings the lower end of the jaw toward an opposed fixed jaw. The swing jaw forces rock upward and causes it to rub against both the fixed and the movable jaw. This rapidly wears out the jaw plates and can consume as much as forty percent of the power imparted to the movable jaw. Being a heavy unbalanced design, this type of crusher must be operated slowly, resulting in a low output and a relatively poor end product.

Typical of a line of improved jaw type crushers is U.S. Pat. No. 3,386,667 to May which discloses a hydraulic actuator for a movable jaw. The movable jaw is pivotally mounted at its upper region with a hydraulic actuating mechanism being connected with the lower region, effective to pivot the jaw about its pivotal mounting. The crusher may be of the type which has a pair of opposed jaws or it may have only a single jaw which is moved toward and away from a fixed jaw. With this mechanism, a high frequency of operation of the crusher jaw is obtained while at the same time great power can be exerted. With this increase in frequency over the earlier conventional designs just discussed, there is an increase in productivity and a better crushed product cubicity. Furthermore, the hydraulic actuating mechanism imparts a higher impact velocity to the crusher jaw and therefore, in turn, to the rock being crushed, thereby more readily fracturing hard materials.

It was with knowledge of the prior art as just described, that the present invention has been conceived and is now reduced to practice. By reason of the present invention, even greater productivity can be achieved while assuring a uniform sought-after end product with minimal wear to the jaw plates and other components of the machine.

SUMMARY OF THE INVENTION

The present invention relates to apparatus provided for crushing rock into aggregate which utilizes a movable jaw operating relative to a fixed jaw. The movable jaw is supported on upper and lower toggle plates which are positioned in non parallel planes. Rock to be crushed is received in an upper entry region defined by the jaws and by opposed cheek plates cooperable with the jaws. Upon reciprocating movement of an hydraulic actuator, a major movement imparted to the movable jaw at its upper region is in a generally upright plane and a major movement imparted to the movable jaw at its lower region is in a generally horizontal plane transverse of the upright plane. In this manner, improved initial cracking of the rock as it enters the upper entry region is achieved and increased production flow of crushed aggregate is achieved at a discharge region by reason, at that location, of the relative horizontal movement between the fixed and movable jaws.

By reason of the present invention, the operative surface of the movable jaw, in the course of its operation, follows a path which is downward and inward relative to the fixed jaw. With the movable jaw oriented in a generally upright plane, and with the fixed jaw lying in a plane which may be, for example, between 30° and 45° from the vertical, an optimal "nipping" angle is thereby achieved. "Nipping" is a term commonly used to refer to the initial cracking of the rock as it enters the top of the crusher. This downward, then inward, motion of the movable jaw has been found to be particularly desirable for initially crushing the rock. However, as the rock approaches the lower region of the jaws, from whence crushed aggregate is discharged, a more horizontal movement of the movable jaw relative to the fixed jaw is desirable so as to constantly change the discharge opening between a maximum opening and a minimum opening. Such movement benefits increased production, allowing passage of more of the crushed aggregate material than was possible with known designs.

In short, the unique motion just described results in an action which grabs the rocks and forces them downward as well as crushing them. This greatly reduces the bobbling of large rocks which occurs particularly in known top eccentric crushers.

Desirably, the operating mechanism for the apparatus of the invention is a hydraulic actuator which eliminates many of the components required by conventional units which were subject to a high incidence of wear, requiring frequent replacement, or reduced effectiveness if they were not replaced. Use of a hydraulic actuator enables a lighter and more compact machine to do the work of a conventional machine without the mass of the flywheels, bearings, and frame necessary to withstand the constant pounding and even the fracture of a toggle plate. This is of particular importance at the present time because of the large number of units being mounted on portable frames.

Still another benefit of a hydraulic actuator is that it enables the movement of the jaw to be selectively lengthened or shortened in a manner not possible with other jaw crushers. It also enables the position of the movable jaw to be readily changed.

The invention is of simplified design substantially improved maintainability over known equipment, and results in a higher rate of production than known designs.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figures 1, 5:
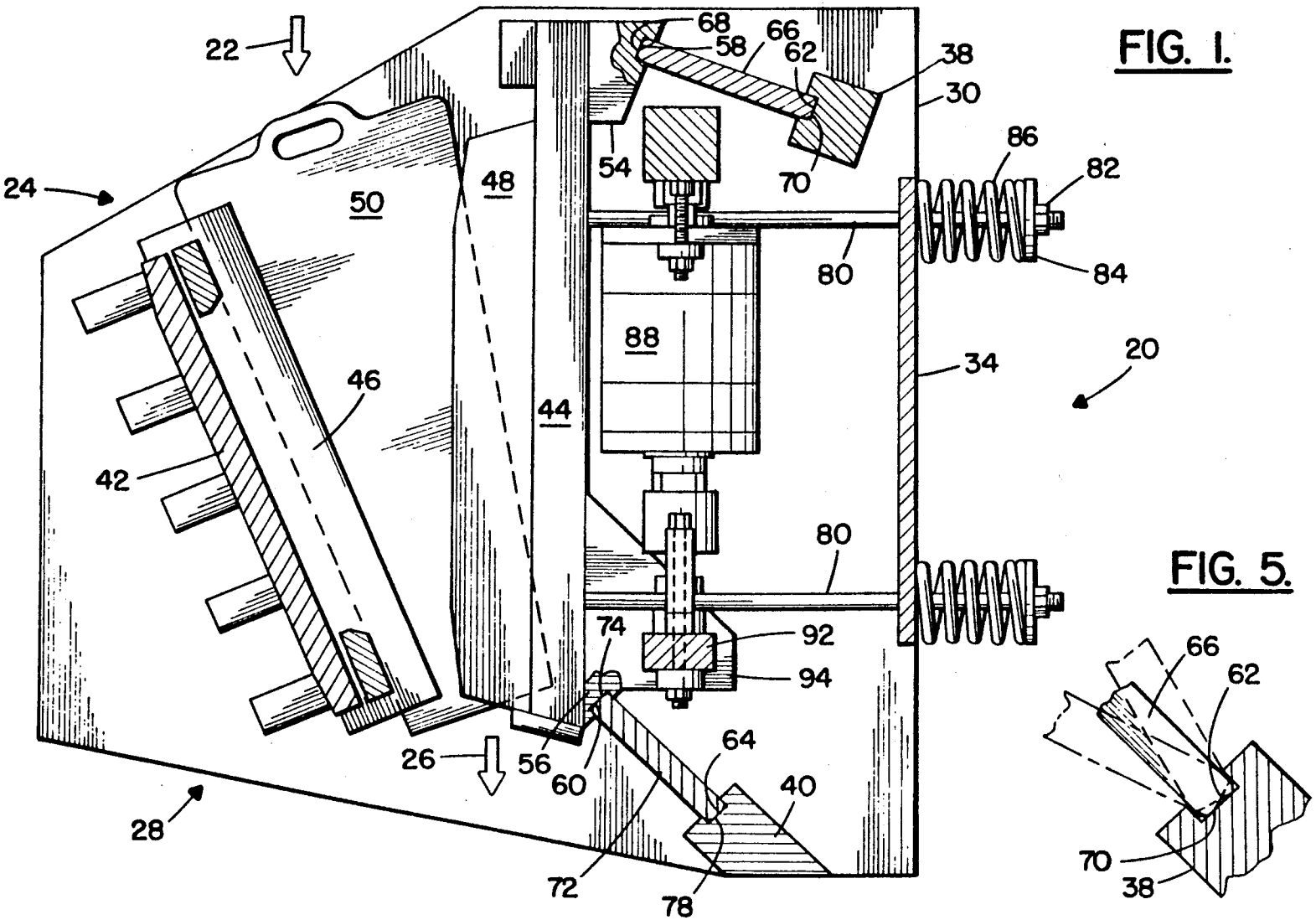
FIG. 1 is a side elevation view of rock crushing apparatus which embodies the present invention, certain parts being cut away and shown in section for clarity.
FIG. 5 is a detail side elevation view, partly in section, of parts illustrated in FIG. 1.
Figure 2:
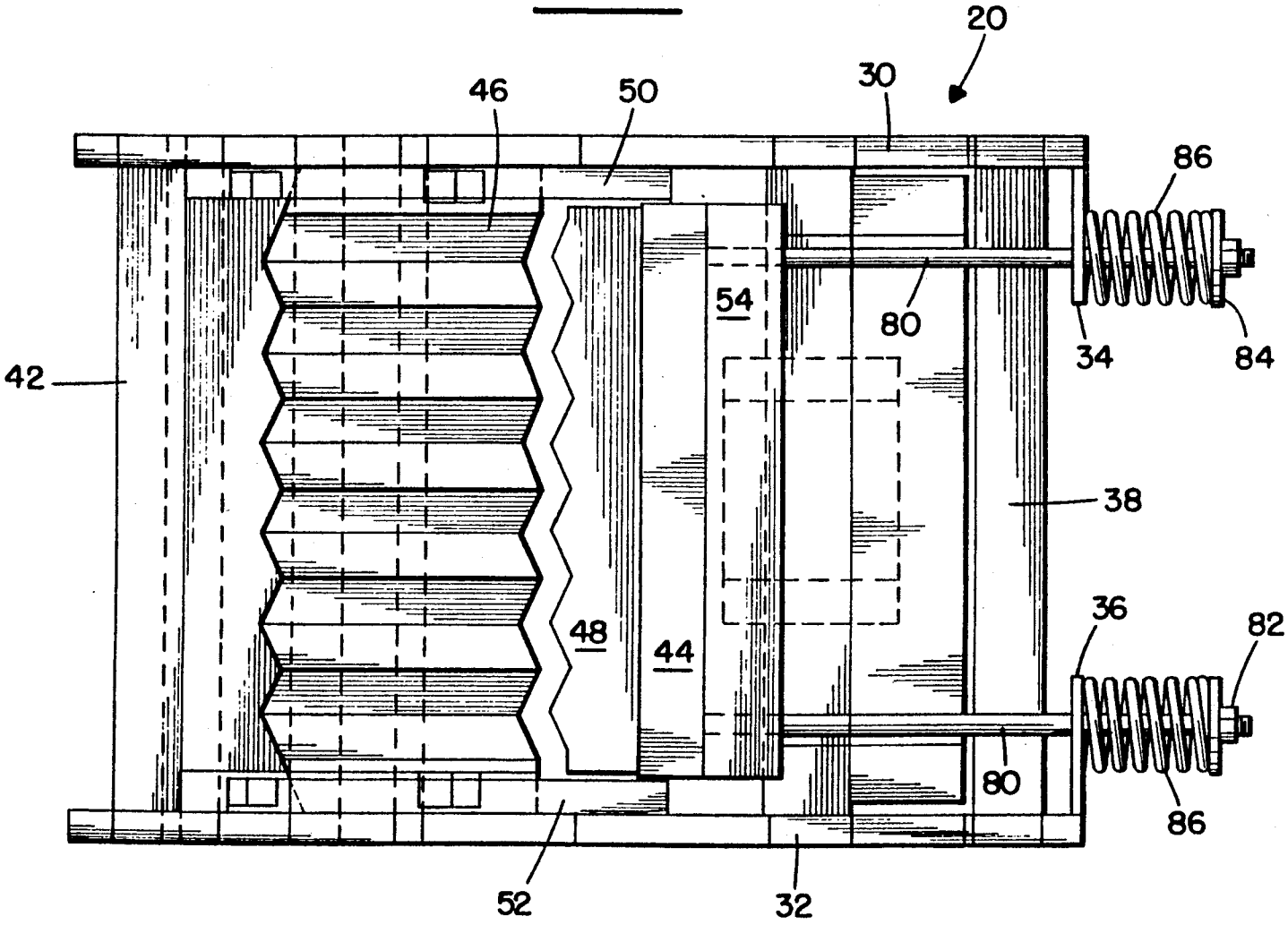
FIG. 2 is a top plan view of the invention illustrated in FIG. 1.
Figure 3:
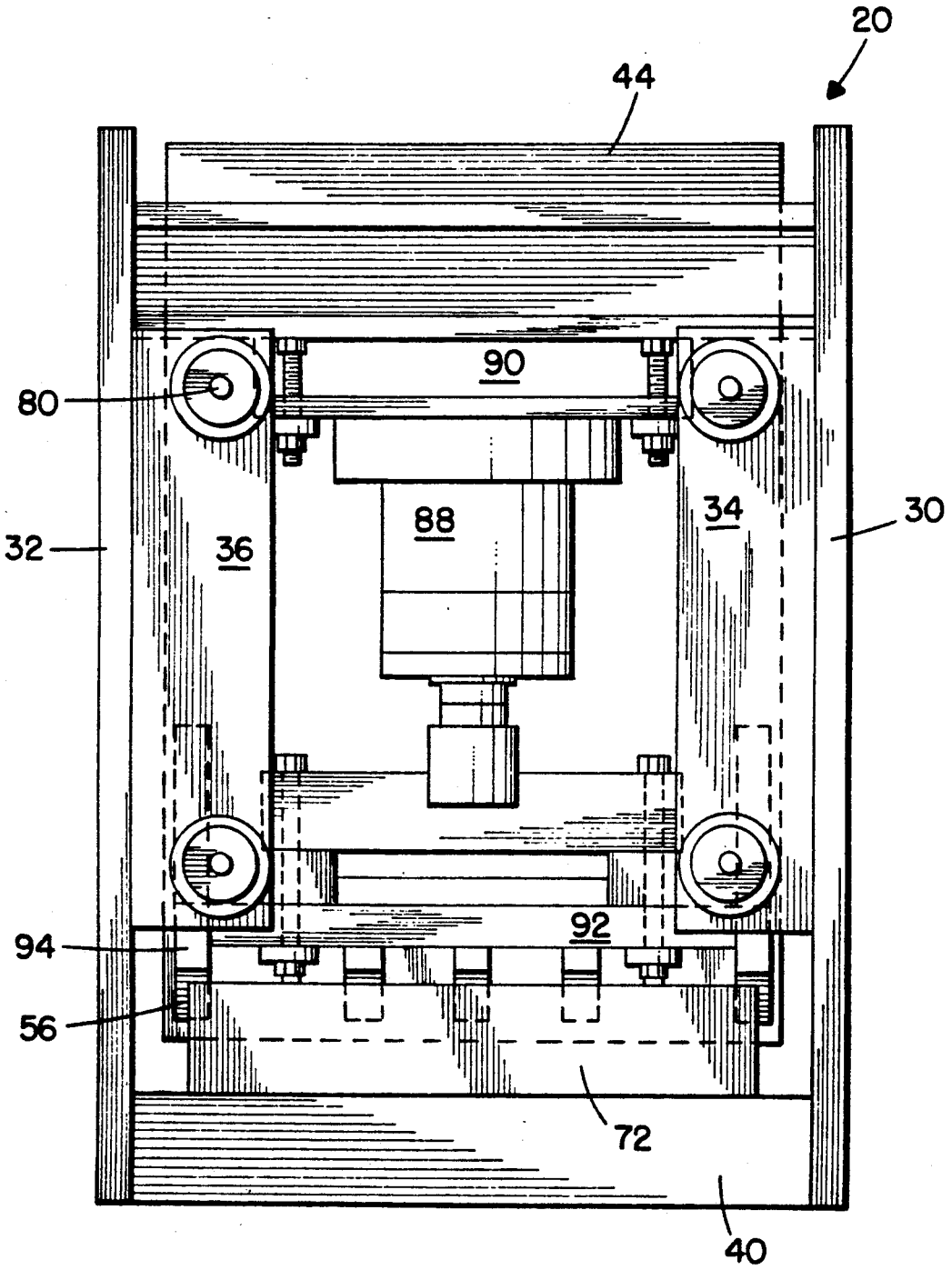
FIG. 3 is a rear elevation view of the invention.

Turn now to the drawings and, initially, to FIGS. 1–4, which illustrate a rock crusher 20 generally embodying the present invention. As best seen in FIG. 1, rock to be crushed is suitably delivered, as schematically represented by an arrow 22 to an upper, entry region of a jaw crushing mechanism 24 of the rock crusher. After operation of the jaw crushing mechanism in a manner to be described, crushed aggregate is expelled from a lower, discharge region as schematically represented by an arrow 26.

The capacity of the rock crusher 20 is governed by the width of the jaw crushing mechanism 24 and by the opening provided at the discharge region. The kind and type of material to be crushed affects the capacity and so does the method of feeding of the material. It will be appreciated that uniform, controlled feeding is essential for maximum production. No two substances are identical in their crushability. Hardness, grain structure, compactability, size and shape of feed, and moisture content all have a bearing on the overall production rate. However, it can be said that the rock crusher of the invention results in a significantly greater production rate than that of a known designs.

The rock crusher 20 has a frame 28 which comprises spaced apart side plates 30, 32, a pair of rear plates 34, 36 substantially perpendicular and integral with the side plates 30, 32, respectively, and laterally disposed upper and lower toggle seat blocks 38, 40. A fixed jaw block 42, angularly disposed, also extends between the side plates 30, 32 and is suitably fixed to them as by welding or by some other suitable fastening mechanism.

A movable jaw block 44 is generally disposed in an upright plane, free of the side plates 30, 32. The fixed jaw block 42 supports a jaw plate 46 which is preferably made of manganese steel, a composition preferred for its hardness and durability. In similar fashion, the movable jaw block 44 supports a jaw plate 48, also preferably made of manganese steel. In typical fashion, the jaw plates 46, 48 are of a corrugated mating design, and a variety of corrugation designs are customarily available to match the material feed size and ensure maximum crusher performance. A pair of cheek plates 50, 52, suitably supported on the side plates 30, 32, protect the sides of the crushing chamber from wear and, together with the jaw plates 46, 48, define the shape and magnitude of the crushing chamber. As with the fixed and movable jaw plates 46, 48, the cheek plates 50, 52 are preferably composed of manganese steel.

Upper and lower toggle seat blocks 54, 56 are integral with the movable jaw block 44 on a side opposite the jaw plate 48. The toggle seat blocks 54, 56 extend laterally across the jaw block 44 and are provided, respectively, with laterally extending bearing grooves or seats 58, 60 therein. The toggle plates and seats are not rounded. Rather, the toggle seat is square and the toggle plate has only a slight chamfer on each edge which allows the toggle plate to rock back and forth. This action results in minimal wear to both the toggle plate and seat. In a similar fashion, the fixed toggle seat blocks 38, 40 are provided with laterally extending squared bearing grooves or seats 62, 64, respectively.

An upper, laterally extending, toggle plate 66 of elongated rectangular shape extends between the toggle seat blocks 54 and 38. A squared but chamfered leading edge 68 of the toggle plate 66 is engagably received in the squared bearing groove or seat 58 and a squared but chamfered trailing edge 70 is engagably received in the squared bearing groove or seat 62 of the toggle seat block 38.

In similar fashion, a lower toggle plate 72, of elongated rectangular shape, extends between the seat blocks 56 and 40. A squared but chamfered leading edge 74 of the toggle plate 72 is engagably received in the squared bearing groove or seat 60 of the seat block 56 and a squared but chamfered trailing edge 78 is engagably received in the squared bearing groove or seat 64 of the seat block 40.

FIG. 5 illustrates, in greater detail, the relative movement between a toggle plate and one of its associated toggle seat blocks. In this instance, a portion of the toggle plate 66 is illustrated being engaged with the toggle seat block 38. It is seen that the bearing groove 62 has substantial depth for receiving the trailing edge 70 of the toggle plate 66. At the same time, the groove 62 has sufficient width to accommodate substantial movement of the toggle plate as indicated, respectively, by solid lines, by dash lines and by dash dot lines.

The toggle plates thereby provide pivoting support for the movable jaw block 44 enabling its full range of motion to achieve maximum crushing pressure. In conventional rock crushers, toggle plates also serve as a safety device, intended and designed to fracture if any uncrushable material enters the crushing chamber of the rock crusher 20, and thereby protect the more expensive components of the rock crusher. In contrast, the toggle plates in the crusher of the invention are not employed as a safety device. Rather, the stalling of the crusher is controlled by the hydraulic pressure admitted to the hydraulic cylinder. This is of a greater advantage than the fracture of a toggle plate because nothing on the crusher is broken and production is regained quickly.

A construction which assures continued engagement between the toggle plates and their associated seat blocks will now be described. A plurality of tension rods 80, four such rods actually being illustrated, are suitably attached at their forward ends to the rear side of the movable jaw block 44. The tension rods 80 are mutually parallel and extend freely through appropriate openings in their associated rear plates 34, 36. The tension rods 80 may be threaded at their rear ends to receive lock nuts 82 thereon. A disk-shaped spring seat 84 may be freely received on each of the rods 80 and held in place by the lock nut 82 to, in turn, support one end of a compression spring 86, the other end thereof engaging a respective one of the rear plates 34, 36. Accordingly, acting through the tension rods 80, the springs 86 bias the movable jaw block 44 in a direction away from the fixed jaw block 42. This biasing action, in turn, serves to firmly hold the leading and trailing edges of the toggle plates 66, 72, in their associated bearing grooves.

Movement of the movable jaw plate 48 is achieved by means of an actuator 88, preferably hydraulic, one end of which is suitably attached to a laterally extending support bar 90 which is suitably fixed at its opposite ends to the side plates 30, 32. At its opposite end, the actuator 88 is suitably attached to a laterally extending actuating bar 92 which, at its opposite ends, is fixedly attached to a pair of operating ears 94 which extend rearwardly from a rear side of the movable jaw block 44. The operating ears lie in substantially parallel, spaced apart planes and are generally parallel to the side plates 30, 32. Hence, with operation of the actuator 88, movement is imparted to the movable jaw block 44 via the actuating bar 92 and operating ears 94. The jaw block 44 and, with it, the jaw plate 48 are moved in a manner determined by the toggle plates 66, 72.

Figure 6:
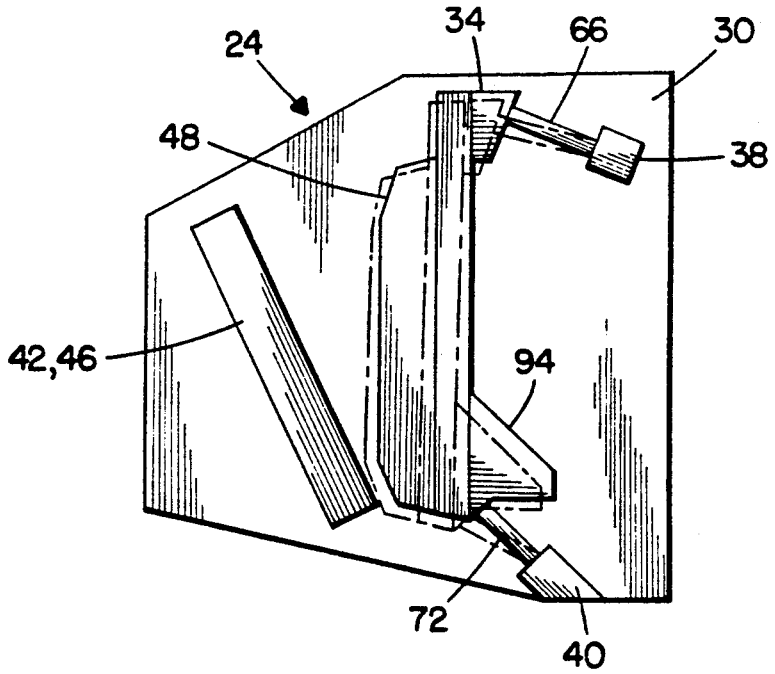
FIG. 6 is a side elevation view, generally similar to FIG. 1, diagrammatically illustrating the operation of the invention.
Figure 4:
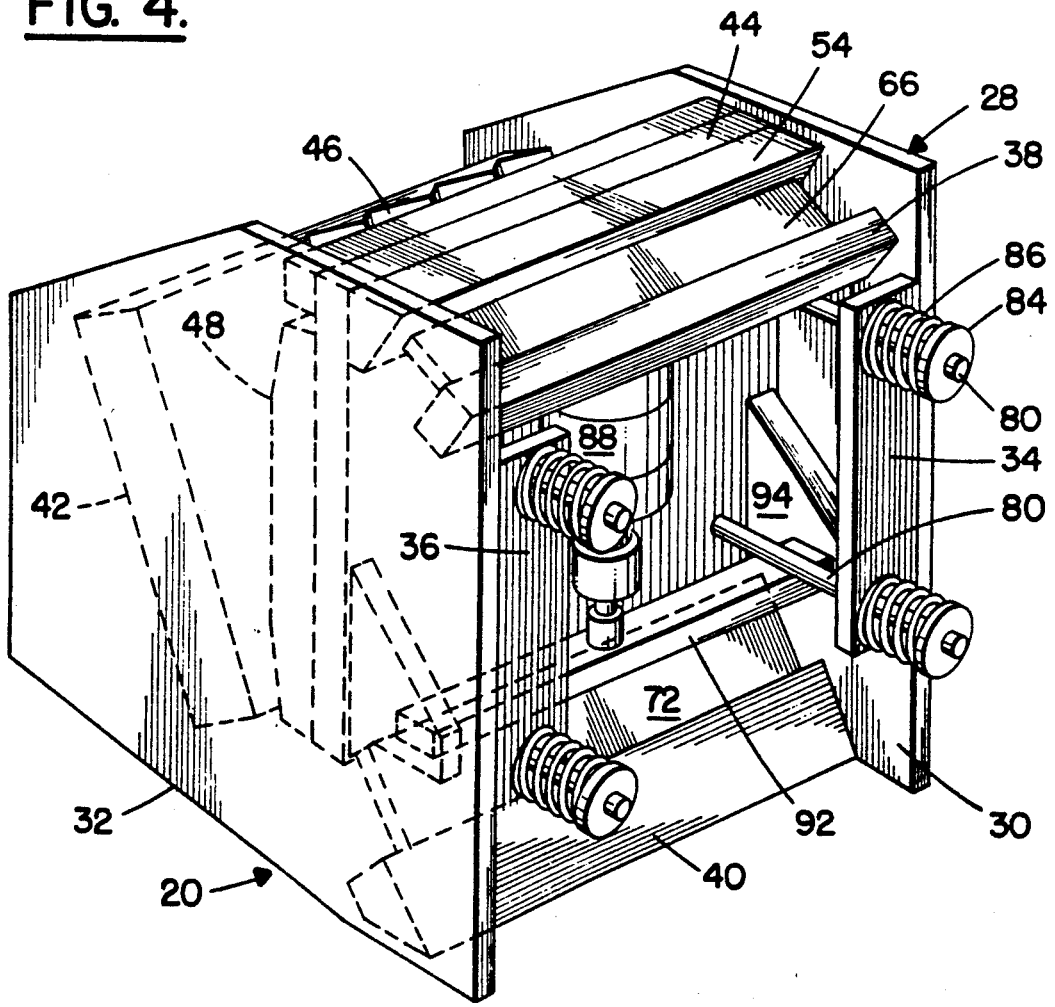
FIG. 4 is a perspective view of the invention illustrated in FIGS. 1–3.

With particular attention to FIG. 1, it is seen that the leading and trailing edges of both toggle plates 66 and 72 are mutually parallel, but that the toggle plates themselves lie in mutually transverse or non parallel planes. As is clearly indicated, the toggle plate 72 lies more nearly in an upright plane than does the toggle plate 66. As a result, a major movement of the upper region of the movable jaw plate 48 is an upright plane and such that a major movement of the lower region of the movable jaw is a generally horizontal plane transverse of the upright plane. This is a unique movement unknown to rock crushers which have previously been available. In FIG. 6, one extreme position of the movable jaw plate 48 is depicted by solid lines, while another extreme position is depicted by dash dot lines.

The generally vertical, but slightly horizontal movement of the jaw plate 48 at its upper region, as generally depicted in FIG. 6, provides a better "nipping" angle for initially cracking the rock as it enters the top of the crushing chamber. However, as the rock passes through the upper region and approaches the bottom of the crushing chamber, more and more fore and aft movement of the jaw plate 48 is effected, again as seen in FIG. 6. This greater and greater horizontal movement of the jaw plate 48 as the crushed aggregate approaches the discharge region insures increased production by enabling a maximum flow between the jaw plates 46, 48 at the discharge region of the crushed aggregate.

While a preferred embodiment of the invention has been disclosed in detail, it should be understood by those skilled in the art that various other modifications may be made to the illustrated embodiments without departing from the scope of the invention as described in the specification and defined in the appended claims.

What is claimed is:

1. Apparatus for crushing rock into aggregate comprising:

a stationary frame;

a stationary jaw fixed to said frame;

a movable jaw lying generally in an upright plane and, together with said stationary jaw, defining an upper region for receiving rock to be crushed and a lower region from which crushed aggregate is discharged;

support means mounting said movable jaw on said frame for movement relative to said stationary jaw such that displacement of said upper region of said movable jaw is substantially restricted to said upright plane and such that displacement of said lower region of said movable jaw is substantially restricted to a generally horizontal plane transverse of said upright plane; and operating means for reciprocably moving said movable jaw relative to said stationary jaw.

2. Apparatus for crushing rock into aggregate as set forth in claim 1 wherein said support means includes:

first toggle means for pivotally mounting said movable jaw on said frame adjacent said upper region; and second toggle means pivotally mounting said movable jaw on said frame adjacent said lower region.

3. Apparatus for crushing rock into aggregate as set forth in claim 2 wherein said first toggle means includes a first generally rectangular laterally disposed toggle plate having parallel spaced apart leading and trailing edges;

wherein said second toggle means includes a second generally rectangular laterally disposed toggle plate having parallel spaced apart leading and trailing edges;

wherein said movable jaw has a forward facing operative surface for engaging the rock and first and second integral toggle seat blocks for movable support thereof, each of said toggle seat blocks being laterally disposed, said first toggle seat block having a laterally extending, rearwardly facing groove for engagably, pivotally receiving said leading edge of said first toggle plate, said second toggle seat block having a laterally extending, rearwardly facing groove for engagably, pivotally receiving said leading edge of said second toggle plate;

wherein said frame includes third and fourth integral laterally disposed toggle seat blocks, said third toggle seat block having a laterally extending, forwardly facing groove for engagably, pivotally receiving said trailing edge of said first toggle plate, said fourth toggle seat block having a laterally extending, forwardly facing groove for engagably, pivotally receiving said trailing edge of said second toggle plate.

4. Apparatus for crushing rock into aggregate as set forth in claim 3 including resilient means for urging said first and second toggle plates into engagement with the grooves in their associated said toggle seat blocks.

5. Apparatus for crushing rock into aggregate as set forth in claim 4 wherein said resilient means includes:

a plurality of generally parallel rod members fixed at their forward ends to said movable jaw, each of said rod members extending freely through openings in said frame means to a free end thereof distant from said movable jaw;

a stop member fixed to each of said rod members adjacent said free end thereof; and compression spring means on each of said rod members intermediate and bearing, respectively, against said frame means and said stop member.

6. Apparatus for crushing rock into aggregate as set forth in claim 3 wherein said leading and trailing edges of said first and second toggle plates are mutually parallel but that said first and second toggle plates lie in mutually transverse planes.

7. Apparatus for crushing rock into aggregate as set forth in claim 6 wherein said first and second toggle plates lie in planes transverse of said operative surface of said movable jaw; and wherein the plane of said second toggle plate is more nearly parallel to the plane of said operative surface than to the plane of said first toggle plate.

8. Apparatus for crushing rock into aggregate as set forth in claim 1 wherein said operating means includes a hydraulic actuator operatively engaged, respectively, to said frame and to said movable jaw.

9. Apparatus for crushing rock into aggregate comprising:

jaw means including a movable jaw for crushing the rock between said entry means and said discharge means, said jaw means defining entry means for receiving rock to be crushed and discharge means for expelling crushed aggregate;

support means mounting said movable jaw for displacement substantially restricted to an upright plane adjacent said entry means and for displacement substantially restricted to a level plane generally transverse of said upright plane adjacent said discharge means; and operating means for reciprocably moving said movable jaw.

10. Apparatus for crushing rock into aggregate as set forth in claim 9 wherein said support means includes:

first toggle means for pivotally mounting said movable jaw to said frame adjacent said upper region; and second toggle means for pivotally mounting said movable jaw to said frame adjacent said lower region.

11. Apparatus for crushing rock into aggregate as set forth in claim 10 wherein said first toggle means includes a first generally rectangular laterally disposed toggle plate having parallel spaced apart leading and trailing edges;

wherein said second toggle means includes a second generally rectangular laterally disposed toggle plate having parallel spaced apart leading and trailing edges;

wherein said movable jaw has a forward facing operative surface for engaging the rock and first and second integral toggle seat blocks for movable support thereof, each of said toggle seat blocks being laterally disposed, said first toggle seat block having a laterally extending, rearwardly facing groove for engagably, pivotally receiving said leading edge of said first toggle plate, said second toggle seat block having a laterally extending, rearwardly facing groove for engagably, pivotally receiving said leading edge of said second toggle plate;

wherein said frame includes third and fourth integral laterally disposed toggle seat blocks, said third toggle seat block having a laterally extending, forwardly facing groove for engagably, pivotally receiving said trailing edge of said first toggle plate, said fourth toggle seat block having a laterally extending, forwardly facing groove for engagably, pivotally receiving said trailing edge of said second toggle plate.

12. Apparatus for crushing rock into aggregate as set forth in claim 11 including resilient means for urging said first and second toggle plates into engagement with the grooves in their associated said toggle seat blocks.

13. Apparatus for crushing rock into aggregate as set forth in claim 12 wherein said resilient means includes:

a plurality of generally parallel rod members fixed at their forward ends to said movable jaw, each of said rod members extending freely through openings in said frame means to a free end thereof distant from said movable jaw;

a stop member fixed to each of said rod members adjacent said free end thereof; and compression spring means on each of said rod members intermediate and bearing, respectively, against said frame means and said stop member.

14. Apparatus for crushing rock into aggregate as set forth in claim 11 wherein said leading and trailing edges of said first and second toggle plates are mutually parallel; and wherein said first and second toggle plates lie in mutually transverse planes.

15. Apparatus for crushing rock into aggregate as set forth in claim 14 wherein said first and second toggle plates lie in planes transverse of said operative surface of said movable jaw, the plane of said second toggle plate being more nearly parallel to the plane of said operative surface than the plane of said first toggle plate.

16. Apparatus for crushing rock into aggregate as set forth in claim 9 wherein said operating means includes a hydraulic actuator operatively engaged, respectively, to said frame and to said movable jaw.

17. A method of crushing rock into aggregate comprising the steps of:

introducing rock to be crushed into an entry region of a rock crusher;

withdrawing crushed aggregate from a discharge region of the rock crusher; and moving a first rock crushing jaw relative to a second rock crushing jaw such that displacement of the first jaw is substantially restricted to an upright plane adjacent said entry region and such that displacement of the first jaw is substantially restricted to a horizontal plane adjacent the discharge region.

18. A method of crushing rock into aggregate as set forth in claim 17 including the steps of:

mounting a first supporting toggle plate for the first rock crushing jaw such that it lies in a first plane transverse of the upright plane; and mounting a second supporting toggle plate for the first rock crushing jaw such that it lies in a second plane transverse of the upright plane and transverse of the first plane but more nearly parallel to the upright plane than the first toggle plate.

* * * * *